US005868615A

United States Patent [19]

Page

[11] Patent Number: 5,868,615

[45] Date of Patent: Feb. 9, 1999

[54] CHIMNEY DRAFT INDUCER

[76] Inventor: Calvin A. Page, P.O. Box 7, South Wellfleet, Mass. 02663

[21] Appl. No.: 32,532

[22] Filed: Feb. 27, 1998

[51] Int. Cl.[6] ..... F23L 17/02

[52] U.S. Cl. ..... 454/36

[58] Field of Search ..... 454/36, 37, 39, 454/40

[56] References Cited

U.S. PATENT DOCUMENTS

| | | | |
|---|---|---|---|
| 297,972 | 5/1884 | Day | 454/37 |
| 1,284,427 | 11/1918 | Moyer | 454/37 |
| 1,326,523 | 12/1919 | Merrill | 454/37 |
| 1,557,852 | 10/1925 | Lauerman | 454/36 |
| 2,401,902 | 6/1946 | Brown et al. | 454/37 |
| 2,753,786 | 7/1956 | White | 454/36 |
| 3,087,409 | 4/1963 | Carr | 454/36 |

FOREIGN PATENT DOCUMENTS

| | | | |
|---|---|---|---|
| 347041 | 1/1922 | Germany | 454/36 |

*Primary Examiner*—Harold Joyce

*Attorney, Agent, or Firm*—William Nitkin

[57] ABSTRACT

A chimney draft inducer installed on a chimney flue having a feed tube extending from the chimney flue with a plurality of vortex stabilizers extending radially from the feed tube to a cylindrical negative pressure plenum member forming a plurality of quasi-venturi chambers therebetween with a conical member positioned above the chimney flue in contact with the vortex stabilizers having an opening between such conical member and feed tube, the conical member having a plurality of arches formed in its bottom, each arch coming to a pointed tip with such pointed tips positioned within each of the quasi-venturi chambers such that air passing down the conical member speeds up when passing by the pointed tips, forming dual air vortexes of low pressure to provide a suction at the chimney flue opening to improve the draft of the chimney.

17 Claims, 3 Drawing Sheets

CHIMNEY DRAFT INDUCER

BACKGROUND OF THE INVENTION

1. Field of the Invention

The device of this invention resides in the field of devices that are positioned above a chimney flue to promote and increase the draft of smoke and air out of the chimney and more particularly relates to an improved ventilator which increases the updraft in a chimney irrespective of ambient air flow direction around the chimney.

2. History of the Prior Art

Typical of the prior art is U.S. Pat. No. 1,246,774 to Moyer patented in 1917. This patent shows a device with a cylindrical outer wall 12 surrounding a conical top member and a bottom member which receives the chimney flue therein, such bottom member spaced apart from the top member, forming circumferentially a spaced opening between the perimeters of the top and bottom members in communication with the flue with exhaust openings defined between such circumferentially spaced opening and the top and bottom of the cylindrical outer wall. In operation irrespective of the wind direction, the chimney flue will have an updraft of air because of the upwards suction pull created by the use of such a ventilator. In FIG. 3 of Moyer one can see that if the ambient air around the chimney is moving horizontally, suction is created between the circumferentially spaced openings and the cylindrical outer wall such that air is pulled out of the chimney flue and can pass out of the top and bottom exhaust openings. When ambient air currents are traveling downward or upwards as shown, respectively, in FIGS. 4 and 5, such air travels into the space between the cylindrical outer wall and the conical top and bottom members. In doing so, a suction is created through the circumferential openings, causing, again, an upwards travel of air in the flue whether the air is exhausted through the top or bottom of the exhaust openings. A similar device to that of Moyer is found in U.S. Pat. No. 1,354,623 to Redgate patented in 1920 which device uses a double tapered deflector disposed above the chimney surrounded by a cylindrical jacket 12 spaced away from the double tapered deflector forming exhaust openings. A similar air flow is created as seen in the drawings of FIGS. 4, 5 and 6 as that of Moyer.

SUMMARY OF THE INVENTION

It is an object of this invention to provide improvements in ventilators of the above-mentioned type.

It is a further object of this invention to provide a ventilator of a design which increases the exhaust velocity of air and creates an upward suction through the flue on which the device is installed.

The prior art in the field does not teach the flow inducement features which create the improved performance of Applicant's ventilator. The Applicant has provided a plurality of vortex stabilizers which extend from the top to the bottom of Applicant's cylindrical outer casing to the flue pipe which vortex stabilizers create a plurality of separate quasi-venturi chambers. While some of the prior art does teach various members extending from around the flue to an outer cylindrical member, the prior art members are primarily for support of the outer cylindrical member and are not structured to provide distinct quasi-venturi chambers as they do not extend for sufficient distance to divide the air flow sufficiently as do the vortex formers of Applicant's device to operate with the other features of this invention to cause increased air flow through the quasi-venturi chambers.

In the present invention Applicant's upper cone is provided with its bottom edge formed with repeating arched scallops, the upper surface of each arched area being an air former and each coming to a point within a quasi-venturi chamber. These points are positioned centrally within each quasi-venturi chamber and as the air flows downward over the cone, the air column first takes the shape of the top surface of each air former until it reaches its edge. When there is a positive pressure on the top of each air former with a lower pressure on its underside, the air column begins to curl under the edges of each air former. As the air mass continues to move downward along the edge of each air former, to where the air former extends ultimately downward to a point, such air flow being directed to travel a longer distance than just to the top of each arch; and as air moves under each air former, it starts to curl under the air former, forming a vortex-like spinning column counter-rotating on each side of the point of each air former. This spinning air moving faster than the other ambient air and causes the spinning air to be lower in pressure by which a low pressure area forms in front of the central opening above the flue and below the laminar baffle and creates a partial vacuum, the suction of which helps draw air and smoke out of the chimney. The dual columns of counter-rotating spinning air extending downward from each point of the air formers are present in each quasi-venturi chamber, the suction of which significantly increases the draft in the chimney and improves the operation of this invention over mere use of the passive prior art devices. The multiple divisions from the circumference of the cylindrical outer casing to the inner opening allow for a plurality of individual downward-spiraling air columns to be created, one in each quasi-venturi chamber which act without interference from one another. The prior art devices generally allowed the air, once it escaped the inner opening, to flow undirected around the circumference inside its outer cylindrical chamber to exhaust as influenced by the ambient air direction.

The level of suction created at the dual air vortex formed at each point is further increased due to the counter-rotating nature of the air columns that are created which air flow also causes a temperature drop to occur. When this temperature drop is below the atmospheric vapor pressure, one can see a trailing wispy cloud of water vapor at the core of the vortex.

DESCRIPTION OF THE PREFERRED EMBODIMENT(S)

Figure 1:
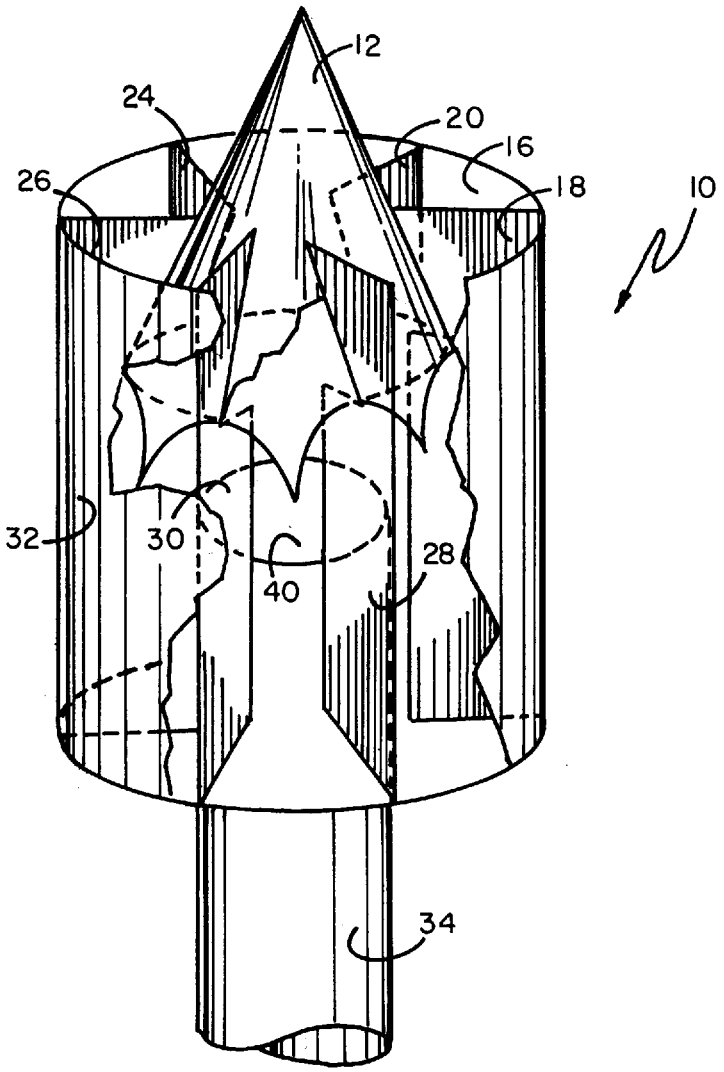
FIG. 1 illustrates a perspective cutaway view of the Chimney Draft Inducer of this invention.
Figure 3:
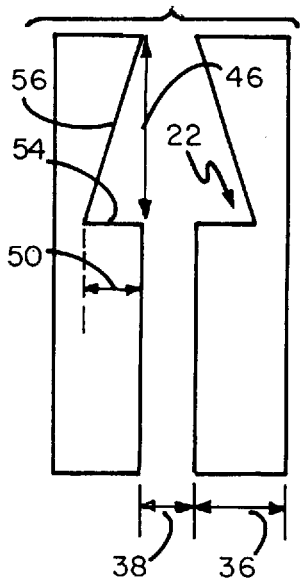
FIG. 3 illustrates a view of two vortex stabilizers.
Figure 2:
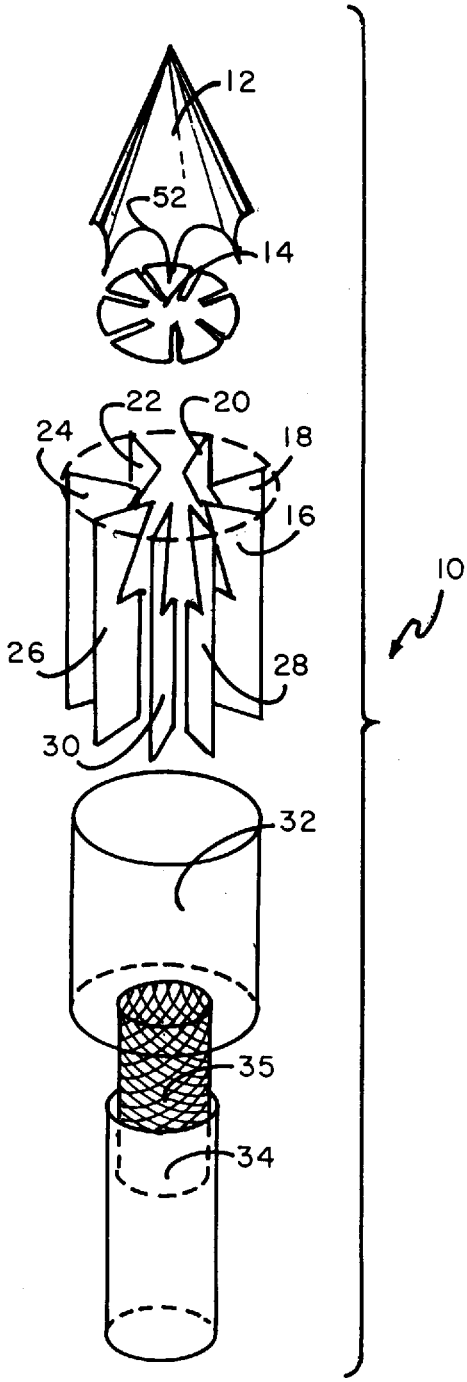
FIG. 2 illustrates an exploded view of the Chimney Draft Inducer of this invention showing its component parts.

The Chimney Draft Inducer as seen in FIG. 1 has feed tube 34 which is positioned at its bottom into a chimney flue. The bottom of the feed tube in some embodiments can be formed in a square or rectangular configuration if the flue opening is rectangular or could be formed in whatever shape the flue opening is configured. Feed tube 34 extends upward and is surrounded by a plurality of vortex stabilizers extending radially out therefrom such as first vortex stabilizer 18, second vortex stabilizer 20, etc. Around the exterior of the vortex stabilizers of Applicant's device is positioned in air-tight relationship thereto a cylindrical member 32 forming a negative pressure plenum 32. Each vortex stabilizer is attached in an air-tight relationship to the top of feed tube 34. A conical member 12 is positioned within a notch 22 formed within each vortex stabilizer, with each vortex stabilizer in an air-tight relationship with the upper surface of conical member 12. A laminar baffle 14, which can be slightly concave, is positioned into the bottom of conical member 12. Conical member 12 has a plurality of pointed tips 42, as seen in FIG. 2, formed between arches 44 spaced around its bottom in a number equal to the number of quasi-venturi chambers 16 formed by the vortex stabilizers disposed around feed tube 34. An opening 40 is defined above feed tube 34 and below laminar baffle 14 of conical member 12 which opening 40 opens into each quasi-venturi chamber such as quasi-venturi chamber 16. In some embodiments a spark arrester 35 made of a mesh material seen in FIG. 2 can extend from feed tube 34 up to laminar baffle 14 to prevent any sparks from exiting through opening 40 as well as to prevent animals from entering through exit 40 to go down the chimney into the fireplace. Between the pointed tips of conical member 12, arches 44 are formed in a logarithmic curve 50; and conical member 12 is structured to position each pointed tip 42 within a central area of each quasi-venturi chamber at approximately the position of opening 40 into such quasi-venturi chamber. Each vortex stabilizer has a notch 22, as seen in FIG. 3, formed therein of a height 46 and width 50 to engage the conical member with the apex 52 of logarithmic curve arch 44, such as positioned at base 54 of notch 22 so that the conical member is held with the vortex stabilizers contacting the upper surface of the conical member, thereby securely retaining it in place with the base of each notch of each vortex stabilizer positioned at apex 52 of each arch 44 between the downwardly extending pointed tips at the base of conical member 12.

Figure 4:
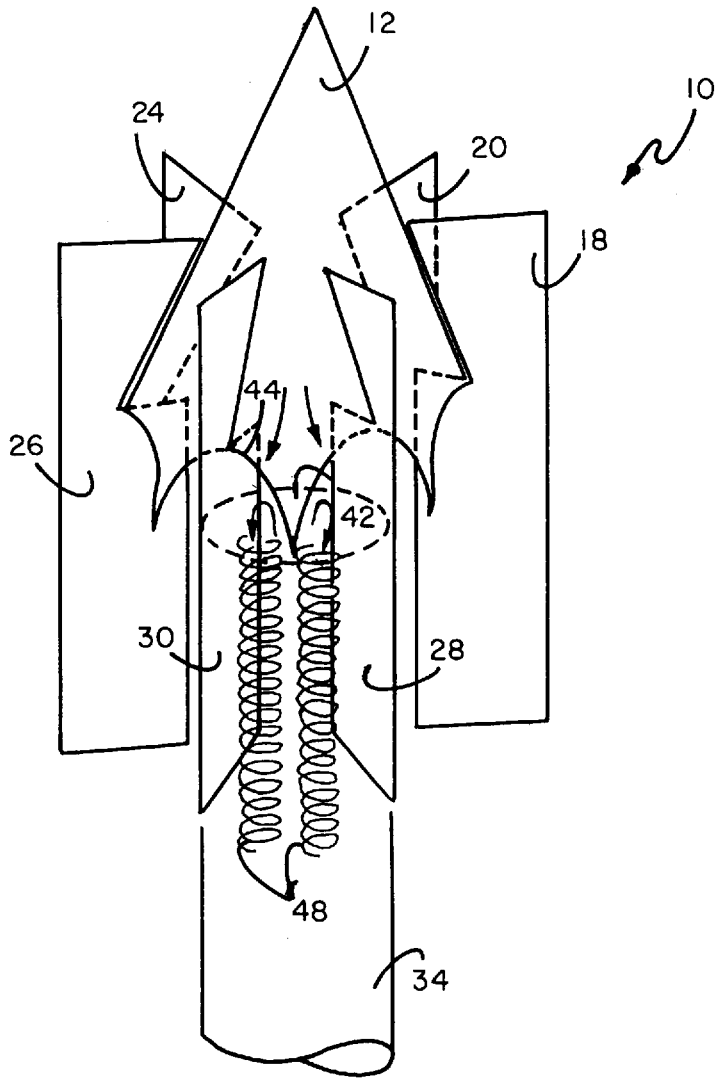
FIG. 4 illustrates a front perspective view of the device with the negative pressure plenum removed, showing a dual vortex air flow formed at a pointed end of the conical member.

Each vortex stabilizer extends completely from the top to the bottom of the negative pressure plenum member 32, and the angular portion 56 of notch 22 conforms to the angle of the upper surface of the conical member so that each vortex stabilizer is attached to the upper surface of the conical member in an air-tight relationship. Within each quasi-venturi chamber, such as chamber 16, a negative pressure is created, as seen in FIG. 4, where the negative pressure plenum member 32 is not shown by air traveling down from the top of conical member 12, over its edges and down toward each point, forming a pair of counter-rotating dual air vortexes. This faster circular air movement creates a lower pressure because of the increased velocity of the air movement and such lower air pressure helps to draw out the air through opening 40 into each quasi-venturi chamber 16, thereby increasing the draft of the chimney. This increased draft occurs separately in each quasi-venturi chamber and causes an increased suction on the centrally located feed tube 34 through central opening 40 into each quasi-venturi chamber. Thus, while the device of this invention enjoys a similar general air flow as those of the prior art, the formation of the quasi-venturi chambers in the preferred embodiment of this invention, being six chambers, each having a downwardly directed pointed tip of the conical member therein creates an improved air flow because of the lower pressure created by the dual air vortexes formed at each side of adjacent arches meeting at each pointed tip.

Although the present invention has been described with reference to particular embodiments, it will be apparent to those skilled in the art that variations and modifications can be substituted therefor without departing from the principles and spirit of the invention.

I claim:

1. A chimney draft inducer for a chimney flue, comprising:

a feed tube extending from said chimney flue;

a cylindrical negative pressure plenum member, having a height, positioned around and spaced away from said feed tube defining a space therebetween;

a plurality of vortex stabilizers, each having a height, each extending radially from said feed tube to said cylindrical negative pressure plenum member, forming a plurality of quasi-venturi chambers therebetween; and a conical member having a bottom, said conical member positioned above said chimney flue and in contact with said vortex stabilizers defining an opening between said feed tube and said conical member said conical member has a plurality of arches forming a plurality of pointed tips therebetween defined at the bottom, each one of said pointed tips portioned within one of said quasi-venturi chambers, said opening extending into each of said quasi-venturi chambers.

2. The chimney draft inducer of claim 1 wherein said height of each vortex stabilizer is equal to the height of said cylindrical negative pressure plenum.

3. The chimney draft inducer of claim 1 wherein said height of each vortex stabilizer is equal to the height of said cylindrical negative pressure plenum member.

4. A chimney draft inducer for a chimney flue having a top, comprising:

a feed tube extending from said chimney flue;

a cylindrical negative pressure plenum member having a height, said cylindrical negative pressure plenum member positioned around and spaced away from said feed tube;

a plurality of vortex stabilizers, each having a height, disposed within said cylindrical negative pressure plenum member, each extending radially from said feed tube to said cylindrical negative pressure plenum member, each of said vortex stabilizers having a notch defined therein, and each notch having an angled portion and a flat base, said vortex stabilizers dividing said space between said cylindrical negative pressure plenum member and said chimney flue into a plurality of separate quasi-venturi chambers, each chamber having an open top and bottom; and a conical member having a pointed top and a bottom, said conical member disposed within said notches defined in said vortex stabilizers, said bottom of said conical member having a plurality of arches defined therein, each arch having a top, first and second sides, and first and second bottom portions, said bottom of said conical member and the top of said chimney flue defining an open space therebetween, said open space opening into each respective quasi-venturi chambers, said first and second bottom portions of said arches forming a plurality of pointed members, each pointed member disposed respectively in each quasi-venturi chamber such that ambient air traveling down said conical member curls around said the tops and sides of said arches and down to said pointed members, said air flowing with increased speed down said conical member around said arches and said pointed members, forming a pair of counter-rotating air vortexes within each of said quasi-venturi chambers, said air vortexes increasing said air's velocity and lowering its pressure to create a suction which helps draw air out through said open space from said feed tube.

5. The chimney draft inducer of claim 4 further including a laminar baffle disposed within said conical member above said tops of said plurality of arches.

6. The chimney draft inducer of claim 5 wherein said vortex stabilizers extend the entire height of said cylindrical negative pressure plenum member.

7. The chimney draft inducer of claim 6 wherein said cylindrical negative pressure plenum member houses six of said vortex stabilizers, dividing said space between said feed tube and said cylindrical negative pressure plenum member into six separate quasi-venturi chambers.

8. The chimney draft inducer of claim 7 wherein said feed tube is of a shape to accommodate the shape of said chimney flue, said chimney draft inducer further including a spark arresting mesh member extending from said feed tube to said laminar baffle around said open space.

9. A chimney draft inducer for use on a chimney flue, comprising:

a feed tube having a top portion and a bottom portion, said bottom portion of a size to fit into said chimney flue with said top portion extending upward therefrom;

a plurality of vortex stabilizers extending radially outward from said top portion of said feed tube, each of said vortex stabilizers having a height, a top, an inner side and an outer side, each of said inner sides having near its top a notch defined therein, each of said notches having an angled portion and a flat base;

a cylindrical negative pressure plenum member disposed around said outer sides of said plurality of vortex stabilizers, said cylindrical negative pressure plenum member having the same height as the height of said vortex stabilizers, said vortex stabilizers forming a plurality of quasi-venturi chambers therebetween; and a conical member having a pointed top and a bottom portion, said conical member spaced above said feed tube, said bottom of said conical member defining an open space therebetween, said open space in communication with each of said quasi-venturi chambers, said conical member having a plurality of arches defined therein, said plurality of arches defining a plurality of pointed tips at the bottom portions of said arches, said plurality of arches in contact with said notches formed in said vortex stabilizers such that said conical member rests above said flat base of each of said notches in said vortex stabilizers and said conical member in contact with said angled portions of said notches of said vortex stabilizers, said pointed tips of said arches each positioned in a quasi-venturi chamber for effecting an increased air flow down and below said conical member and creating a suction to aid in drawing air from said feed tube and out said quasi-venturi chambers.

10. The chimney draft inducer of claim 9 wherein said vortex stabilizers are substantially equally-spaced from one another and said air flowing over said conical member curls around said arches formed at the bottom portion of said conical member to move downwardly forming counter-rotating air vortexes in each quasi-venturi chamber.

11. The chimney draft inducer of claim 10 further including a laminar baffle positioned in the bottom portion of said conical member above said open space.

12. The chimney draft inducer of claim 11 wherein said cylindrical negative pressure plenum member surrounds six vortex stabilizers forming six quasi-venturi chambers.

13. A chimney draft inducer for increasing updrafts in a chimney, comprising:

a feed tube having a bottom portion which protrudes into said chimney;

a plurality of vortex stabilizers, each having a top, a bottom, an inner side and an outer side, said vortex stabilizers surrounding said feed tube and extending radially outward therefrom, each of said vortex stabilizers having a notch defined in said inner sides thereof, a cylindrical negative pressure plenum member surrounding said vortex stabilizers and extending in height the same distance as said height of said vortex stabilizers, said cylindrical negative pressure plenum member positioned in a substantially air-tight relationship with said outer sides of said vortex stabilizers;

a conical member having a pointed top and a bottom portion, said bottom portion of said conical member disposed within said notches of said vortex stabilizers, said conical member having its pointed top facing upward; and a plurality of arches defined in the bottom portion of said conical member, each of said arches having a top arched portion and a bottom portion, said bottom portions forming a plurality of pointed tips which protrude into the areas between said vortex stabilizers, said pointed tips receiving air from above which curls around said arches and pointed tips, creating a suction which helps draw air upward from said chimney.

14. The chimney draft inducer of claim 13 wherein said vortex stabilizers are substantially equally spaced apart forming a plurality of quasi-venturi chambers wherein said air curling around said pointed tips forms downwardly moving counter-rotating air vortexes of lower pressure and increased air speed than that of the ambient air.

15. The chimney draft inducer of claim 14 wherein each of said pointed tips of said arches is angled downward, respectively, into each one of said quasi-venturi chambers.

16. The chimney draft inducer of claim 15 further including a laminar baffle positioned in said bottom portion of said conical member above said plurality of arches.

17. The chimney draft inducer of claim 16 wherein said cylindrical negative pressure plenum member surrounds six vortex stabilizers, forming six quasi-venturi chambers.

* * * * *